United States Patent [19]

Yang et al.

[11] 4,218,619

[45] Aug. 19, 1980

[54] MULTI-COPY ION-VALVE RADIOGRAPHY

[75] Inventors: Kei-Hsiung Yang; Lothar A. Gruenke, both of Schenectady, N.Y.

[73] Assignee: General Electric Company, Schenectady, N.Y.

[21] Appl. No.: 942,548

[22] Filed: Sep. 15, 1978

[51] Int. Cl.[2] ..... G03G 15/00

[52] U.S. Cl. ..... 250/315.2

[58] Field of Search ..... 250/315 A

[56] References Cited

U.S. PATENT DOCUMENTS

| | | | |
|---|---|---|---|
| 3,961,192 | 6/1976 | Ando | 250/315 A |
| 3,975,626 | 8/1976 | Van Engeland et al. | 250/315 A |

*Primary Examiner*—Alfred E. Smith
*Assistant Examiner*—T. N. Grigsby
*Attorney, Agent, or Firm*—Geoffrey H. Krauss; James C. Davis; Marvin Snyder

[57] ABSTRACT

A method and apparatus for ion-valve radiography allowing a multiplicity of copies to be made responsive to a single radiographic exposure. Radiation, differentially-absorbed by passage through an object to be studied, enters an exposure chamber having a foraminate film or mesh structure surrounded by a high pressure gas or radio-conductive liquid of a type which converts the impingent radiation into electrostatic charge. The chamber is bounded by a pair of electrodes establishing electric fields therein to cause a charge image of the object to form upon an insulating layer contained upon the mesh structure. After exposure, the charge-image-bearing member is moved to a printing chamber and a charge image is deposited upon an insulative material sheet by ion flow techniques, for subsequent development by xerographic techniques.

28 Claims, 2 Drawing Figures

10
11
11a
11b
11c
12
12a
12b
14
16
18
20a
20b
22
23
25
27
27a
28
30
30a
30b
30c
30d
35
38
40
40'
42
45
50
55
60
60a
62
62a
65
67
68
70
71
71'
72
75
$D_C$
$D_A$
$D_B$
L
d
$T_1$
$T_2$
$E_A$
$E_B$
$E_P$
$V_A$
$V_B$
$V_A'$
$V_B'$
$S_1$
$S_2$
$S_3$
G
F

MULTI-COPY ION-VALVE RADIOGRAPHY

BACKGROUND OF THE INVENTION

The present invention relates to radiation imaging apparatus and methods and, more particularly, to a novel method and apparatus for ion valve electroradiography, wherein a multiplicity of copies may be secured from a single radiation exposure.

It is well known that radiation, such as X-radiation utilized for medical diagnostic purposes, can be converted into an electrostatic charge image by either a gas, such as Xenon, Krypton, Freon, and the like, under pressure or a radio-conductive liquid, such as tetramethyl-tin (TMT) and the like. The electrostatic charge image so converted from X-radiation is receivable by a layer of dielectric material for subsequent development into a visible image by conventional xerographic techniques. Apparatus and methods utilizing formation of an electrostatic charge image are described in, e.g. U.S. Pat. No. 3,859,529, issued Jan. 7, 1975; U.S. Pat. No. 3,927,322, issued Dec. 15, 1975; U.S. Pat. No. 3,961,192, issued Jan. 1, 1976; and U.S. Pat. No. 4,064,439, issued Dec. 20, 1977 and assigned to the assignee of the present invention. These exemplary disclosures are incorporated herein by reference.

The sensitivity, in terms of input X-radiation dosage on the x-ray absorber, of these electroradiographic systems is somewhat limited by either x-ray quantum mottle or the minimum developable charge density of commercially available toners utilized to render visible the charge-bearing areas of the insulative film. Generally available commercial toners require an average charge density which exceeds ten nanocoulombs per square centimeter ($nC/cm^2$). The most sensitive toners, which are not generally available, can develop charge images having an average charge density of $2nC/cm^2$. In apparatus having a pair of electrodes enclosing a volume of the radiation-to-charge converting gas or liquid and with the insulative sheet disposed upon the interior surface of that electrode receiving the differentially-absorbed radiation pattern, the resulting radiation dosage required to generate visible images of high quality is greater than an acceptable x-radiation dosage, i.e. an exposure of about 1 milli-Roentgen (mR). Typical sensitivities and dosages can be derived from data published in 1 *Medical-Physics* 1,262 (A. Fenster et al., 1974) and summarized in the following table:

TABLE

| Conversion Material | X-Ray Spectra ($kV_p$) | Electrode Gap (mm.) | Sensitivity ($nC/cm^2$-mR) | Approx. Dosage (mR.) |
|---|---|---|---|---|
| TMT | 65 | 2 | 0.9 | 11.1 |
| (100kV/cm field) | 80 | 2 | 1.2 | 8.3 |
| | 100 | 2 | 1.9 | 5.3 |
| | 65 | 4 | 1.0 | 10.0 |
| | 80 | 4 | 1.3 | 7.7 |
| | 100 | 4 | 2.2 | 4.5 |
| XENON | 65 | 10 | 2.2 | 4.5 |
| (10 atmospheres) | 80 | 10 | 2.9 | 3.4 |
| | 100 | 10 | 3.3 | 3.0 |
| FREON 13B1 | 65 | 10 | 0.7 | 14.3 |
| (10 atmospheres) | 80 | 10 | 0.75 | 13.3 |
| | 100 | 10 | 0.8 | 12.5 |

It will be seen that visible images require an exposure at least 200% higher than the desired maximum exposure level of 1 mR. In addition, most electroradiographic systems, with the exception of that described in the aforementioned U.S. Pat. No. 4,064,439, can only produce a single radiographic image per radiation exposure, whereby duplication of the original copy must be accomplished by other techniques, such as conventional photocoping using expensive silver-halide film or diazotype prints, with progressively greater defect magnitudes occurring as copies are made of copies, etc. Accordingly, a method and apparatus which cannot only increase the sensitivity of an electroradiographic system, to require an exposure dosage no greater than 1 milli-roentgen, and which can also facilitate generation of multicopies of the radiographic image, as required, is highly desirable.

BRIEF DESCRIPTION OF THE INVENTION

In accordance with the invention, apparatus for ion-valve radiography includes a pair of conductive, spaced-apart electrodes with the volume therebetween filled with a gaseous or liquid material characterized by conversion of radiation to electrical charge, and with a foraminate film or mesh structure, having a conducting layer supporting an insulating film on the surface thereof closest to the electrode receiving the differentially-absorbed radiation, inserted between the two electrodes. Electric fields are established through the region of conversion material situated between the radiation-receiving electrode and the conductive mesh, and the region between the mesh and the remaining electrode, with the fields being of substantially equal magnitudes. The conversion material creates electrons and ions responsive to the magnitude of radiation received, with part of the ions created in the conversion material region, between the radiation-receiving electrode and the conductive mesh, being received on the surface of the insulative layer of the mesh. Means are provided for grounding the pair of electrodes and the mesh after radiation exposure, and for moving the mesh structure to a preselected distance parallel to another electrode supporting an insulative layer upon a surface thereof closest to the charge-bearing insulative layer of the mesh. Ions, of like polarity to the ions received on the mesh insulative layer surface, are then projected from beyond the conductive portion of the mesh toward the mesh, with passage of the projected ions through the interstices of the mesh being modulated by the charge pattern stored on the insulative layer of the mesh. The modulated ion streams produce a charge image, upon the electrode-supported layer, reconstructive of the radiation-absorption features of the object to be studied. The decay time of the charge image on the surface of the insulative layer of the mesh structure is relatively long, whereby relatively long time intervals of ion projection can be utilized to produce high contrast images, and whereby relatively large numbers of copies of the charge image can be generated from a single radiation exposure.

In one preferred embodiment, the conversion material is tetra-methyl-tin (TMT) liquid and the insulative layer of the mesh structure is pre-exposed, to radiation or charge, i.e. without the presence of the object (patient) to be studied, to deposit a uniform background charge density on the mesh prior to exposure of the patient, thus facilitating generation of radiographic images having resolutions of at least twenty line-pairs per millimeter with a radiation dosage not exceeding 1 milli-Roentgen.

In another preferred embodiment, wherein high pressure gasses of Xenon, Krypton of Freon are utilized, a curved electrode, having a center of curvature situated at the focus of the radiation source, can be utilized to replace the pair of electrodes during exposure. Flat electrodes which generate a converging electric field, in the direction towards the radiation source, can also be utilized and with the mesh structure being placed upon the radiation receiving, equipotential electrode thereof.

Accordingly, it is an object of the present invention to provide novel radiation imaging apparatus of a type allowing a multiplicity of copies of the radiation image to be obtained and at an acceptable radiation exposure dosage to the patient.

This and other objects of the present invention will become apparent to those skilled in the art upon consideration of the following detailed description, when taken in conjunction with the drawings.

DETAILED DESCRIPTION OF THE INVENTION

Figure 1:
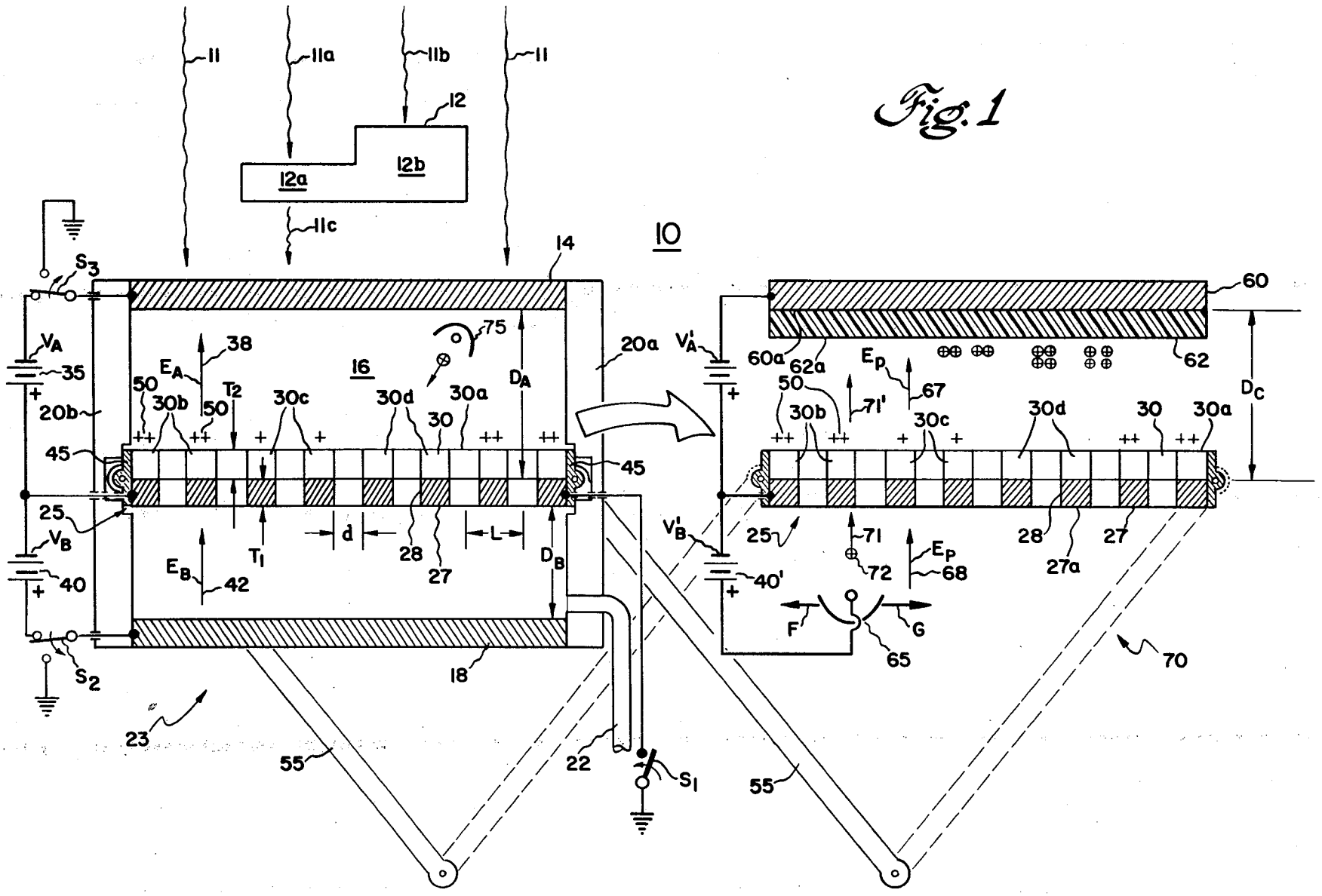
FIG. 1 is a sectional side view of one presently preferred embodiment of multi-copy ion-valve radiographic apparatus, in accordance with the principles of the present invention.

Referring initially to FIG. 1, ion-valve radiographic apparatus 10 is utilized to provide a multiplicity of copies of the pattern of absorption of radiation 11, such as X-radiation and the like, differentially absorbed during passage through an object 12 to be studied. Portions of X-radiation 11 do not pass through object 12 and so arrive at apparatus 10 with substantially no attenuation thereof; other radiation quanta pass through the object and are attenuated thereby in accordance with the relative absorption of that portion of the object to which each quanta travels. Thus, X-ray quanta 11*a* passes through a thinner portion 12*a* of the object, wherein energy is absorbed and the quanta emerges as quanta 11*c* having a relatively lower energy flux. Another quanta 11*b* enters a relatively thick portion 12*b* of the object, and, if portion 12*b* is of sufficient density and/or thickness, quanta 11*b* is completely absorbed therein, i.e. radiation does not pass through denser portion 12*b*.

The differentially-absorbed radiation impinges upon the outer surface of a first conductive, planar electrode 14 and is transmitted therethrough to a quantity of a material 16, contained between first electrode 14 and a second conductive, planar electrode 18 positioned parallel to and spaced therefrom. Material 16 is characterized by conversion of incident x-rays to charged particles and may be a liquid, such as tetra-methyl-tin (TMT) and the like, or a gas, such as Xenon, Krypton, Freon and the like, under high pressure. A suitable container is formed by the addition of sidewalls 20*a* and 20*b* (plus end walls, not shown), formed of electrically insulative materials, to allow the gaseous or liquid material to be pumped from a source (not shown) via an input-output connection 22 into the exposure chamber 23 defined between the first and second electrodes 14 and 18 and be maintained therein at the required pressure. A mesh structure 25 is positioned within the chamber and parallel to electrodes 14 and 18. The mesh structure may be a foraminate film or a conductive mesh member 27 having an array of apertures 28 formed therethrough, with a layer 30 of insulative material supported upon the solid portions of the mesh surface facing the radiation-receiving electrode 14. Mesh 27 preferably has spacing L between centers of apertures 28, on the order of 40 microns, and has about 50% or greater transmission, whereby the diameter d of each aperture 28 is in one preferred mean about 28 microns, for a mesh of thickness $T_1$ of about 8 microns. The mesh may be formed of any material having sufficient tensile strength and may include metals such as copper, nickel, ion, and chromium and metallic alloys such as stainless steel, and the like. The materials may be conductive or semiconductive but must have a resistivity less than about $10^9$ ohms-centimeter. Insulative layer 30 is formed to a typical thickness $T_2$ of between about 3 microns and about 40 microns, and may be fabricated of an inorganic material, such as silicon dioxide, glass, and the like, or an organic material such as polystyrene, polyester resins, polypropylene resins, polycarbonate resins, acrylic resins, vinyl resins, epoxy resins, polyethylene terephthalate and polyfluoride resins, polydiphenyl siloxane, and the like. Similar insulative materials may be utilized, so long as the resistivity of insulating layer 30 is greater than about $5\times10^{15}$ ohms-centimeter.

A first potential source 35 of magnitude $V_A$ is connected between radiation-receiving electrode 14 and conductive mesh 27, with polarity such that the mesh is positive with respect to electrode 14. The source magnitude $V_A$ and the separation distance $D_A$, between facing surfaces of the radiation-receiving electrode 14 and the conductive mesh 27, are coordinately established to provide a first electric field 38 of magnitude $E_A$ and directed through the conversion material 16 from mesh 27 toward electrode 14. A second electrical potential source 40, of magnitude $V_B$, is connected between mesh 27 and electrode 18 with polarity such that the electrode is more positive than the mesh; the facing surfaces of mesh 27 and electrode 18 are separated by a distance $D_B$, whereby an electric field 42 of magnitude $E_B$ is created and directed from the electrode towards the mesh. Advantageously, the magnitudes of fields 38 and 42 are substantially equal, i.e. $E_A$ is approximately equal to $E_B$. Typically, the separation distance $D_B$ between the mesh and lower electrode 18 is on the order of 2 to 4 millimeters. It should be understood that the separation distance $D_B$ is governed by the amount of distortion of the thin mesh structure 25, responsive to the electric field passing therethrough. As the periphery of mesh structure 25 is supported by a frame 45 (having only the right and left end portions thereof shown in section in FIG. 1) the periphery of the mesh remains relatively undistorted, with maximum distortion occurring at the center of the mesh and towards one of electrodes 14 or 18. If a sufficiently strong mesh 27 is utilized as to reduce this distortion the separation distance $D_B$ between facing surfaces of the mesh and the electrode 18, can be reduced, with a reduction in the magnitude $V_B$ of potential source 40. A rigid mesh 27 will allow reduction of separation distance $V_B$ substantially to zero, with replacement of source 40 by a short circuit.

In operation, object 12 is exposed and the differentially absorbed radiation is transmitted through electrode 14 into conversion material 16. The radiation quanta are converted into charged particles, i.e. negatively-charged electrons or ions and positively-charged ions. A portion of the ions created in the region between electrode 14 and mesh 27 travel to the insulative layer surface 30*a* closest to electrode 14; the positive charge received at each portion of surface 30*a* is proportional to the amount of radiation received in the conversion material volume above that surface portion and is, accordingly, inversely proportional to the absorption of the radiation by object 12. Thus, those portions 30*b* of the insulative layer receiving the substantially-unattenuated radiation 11, which does not pass through the object, have a greater number of positive charges 50 adjacent to the surface thereof than other areas 30*c* of the insulative layer which are beneath the thinner portion 12*a* of the object and so receive a lesser magnitude of charge responsive to the attenuated magnitude of radiation 11*c* entering the chamber. Other areas 30*d* of the insulative layer, being positioned beneath the relatively thick and dense portions 12*b* of the object, receive substantially zero charge-because of the absorption of radiation quanta 11*b* within the object.

After exposure of the object, the conductive mesh member 27, the lower electrode 18 and the radiation-receiving electrode 14 are all grounded, as by operation of respective switch means $S_1$, $S_2$ and $S_3$ in the direction of the associated arrows. The conversion material 16 is pumped, via tube 22, from the chamber and the chamber is opened, as by removal of chamber side 20*a*. The frame 45 is urged out of the chamber, and is supported by suitable means, such as pivotable legs 55 pivotably mounted to the front and rear side of frame 45, to allow translation of the mesh structure 25 from the exposure chamber volume and into a development chamber 70. The mesh structure is positioned with the grounded mesh 27 parallel to another planar electrode 60, separated from the facing surface of mesh 27 by a distance $D_C$. A sheet 62 of an insulative material, such as plastic and the like, is supported by the electrode surface 60*a* closest to the mesh structure. A potential source 35' impresses a voltage of magnitude $V_A'$ between mesh 27 and electrode 60, and with the mesh at positive polarity with respect to the electrode. A second potential source 40' impresses a voltage of magnitude $V_B'$ between the mesh and an ion source 65, with the ion source being maintained at a positive polarity with respect to the mesh. Voltage sources 35' and 40' may be the same sources 35 and 40 utilized to provide potentials to electrodes 14 and 18, with respect to mesh 27, in the exposure chamber. The voltage magnitudes $V_A'$ and $V_B'$, in the development chamber 70, are coordinated with the electrode-mesh separation distance $D_C$ and the separation between the mesh and the ion source 65, respectively, to produce respective first and second fields 67 and 68 of approximately equal magnitude $E_p$ and directed sequentially from the ion source toward the mesh and thence toward electrode 60. Mesh 27 remains at ground potential and the ion source, which may be a scorotron, corotron and the like, projects a stream of charged particles 70, of like polarity to the charge 50 contained adjacent to insulative layer surface 30*a*, toward the surface 27*a* of the mesh furthest from insulative layer 30. The ion source is arranged for movement, in directions of arrows F & G, to direct the stream 71 of ions 72 sequentially over the entire mesh surface 27*a* and through all of mesh apertures 28. Ions 72 are accelerated by field 68 and subsequently arrive at mesh 27; those of ions 72 passing through mesh apertures 28 encounter the varying magnitudes of charge distribution at the exit ends of the apertures. As the charge 50 is of like polarity to the charge of ions 72, the strength of the ion stream 71', leaving the mesh structure 25 towards insulative sheet 62, is inversely proportional to the magnitude of charge previously deposited upon each "island" of insulative material. Thus, when the ion stream passes through an aperture flanked by insulative areas 30*b*, having a relatively large magnitude of charge 50 adjacent to the surface thereof, like-polarity interaction substantially prevents any of the ions from passing into the volume between mesh structure 25 and electrode 60, whereby substantially no charge is deposited upon the surface of insulative layer 62 facing the mesh structure and aligned with insulative material layer areas 30*b*. When the stream 71 of charge particles 72 enters other apertures 28 surrounded by other portions 30*c* of the insulative material layer, which portions 30*c* have a lesser magnitude of charge 50 adjacent to the surface thereof, the like-polarity charge interactions are correspondingly weaker and a small amount of ions exits from the associated apertures and are accelerated by field 67 for deposition upon the insulative material layer surface 62*a*. The ion stream passing through apertures 28 through those portions 30*d* of the insulative layer upon which substantially no charge was deposited, due to the absorption of x-ray quanta in the associated portion of the object to be studied, are accordingly not involved in like-polarity interactions and substantially all of the source-emitted ions 72 passing through these apertures are accelerated by field 67 and are deposited upon the insulative sheet surface 62*a*. Therefore, an image of charge, in magnitude proportional to the density of the object to be studied, is deposited upon the surface 62*a* of the insulative sheet supported by electrode 60. The charge image on sheet 62 is subsequently developed using a toner and known xerographic techniques.

As the decay time of the insulative material utilized for insulative layer 30 is relatively long, charges 50 remain adjacent to the layer surface and act upon ion stream 71 for relatively long periods of time, whereby the amount of charge deposited upon sheet 62 can be built up over a period of time to be greater than the amount of charge forming the charge "islands" on the mesh structure and enhanced contrast can be provided. It can be seen that, after deposition of a charge image on a first sheet 62, the first sheet can be removed for development and subsequent sheets of insulative material can be positioned upon electrode surface 60*a* and the ion source again caused to traverse the mesh surface while emitting a stream of ions through all the apertures of the mesh assembly, thereby providing a charge image on a sequential multiplicity of sheets, as facilitated by the relatively long charge decay time of the charge image at the mesh structure.

The resolution of the ion-projected image is dependent upon the aperture dimension d and the aperture center-to-center dimension L of the mesh and is also dependent upon the magnitude $E_p$ of the ion projection field. Advantageously, we can increase the magnitude $E_p$ of the ion projection field by increasing the charge density on the surface 30*a* of the mesh structure insulative layer 30. This is accomplished by pre-exposing the insulative layer 30, without the presence of the patient, to achieve a uniform background charge density $\sigma_o$ thereon. The pre-exposure can be either by directing radiation 11 at exposure chamber 23 to cause the background charge density $\sigma_o$ to build up across the entire surface 30*a* of the insulative layer of the mesh structure, or by depositing the uniform background charge density $\sigma_o$ thereon by means of an ion emitter 75, such as a scorotron, corotron and the like, caused to traverse the insulative layer 30a from a position adjacent to the interior surface of electrode 14. After pre-exposure, the object 12 to be studied is moved into position in front of the exterior surface of electrode 14 and the image exposure completed. Typically, when the maximum image charge density $\sigma_{iM}$ is on the order of 0.9 nC/cm$^2$, and the minimum image charge density $\sigma_{im}$ is on the order of 0.1 nC/cm$^2$ with a mesh structure having 50% transmission and an average charge density of 1.0 nC/cm$^2$ due to x-ray exposure when object 12 is present, a positive uniform background charge density $\sigma_o$ of about 3 nC/cm$^2$ may be utilized. Similarly, the pre-exposure uniform background charge may be of negative ions or electrons with a typical uniform background charge density $\sigma_o$ of about $-4$ nC/cm$^2$ being utilized. It should be understood that opposite polarity charges may be used equally as well, with the polarity of the voltage sources 35, 35', 40, 45'; ions 72; charges 50; and direction of fields 38, 42, 67 and 68 being reversed.

The magnitude $E_p$ of the ion projection field is approximately equal to $(\sigma_o+\sigma_{iM})/(3K\epsilon_o)$, where $\epsilon_o$ is the dielectric constant of air and K is a relative dielectric constant of the mesh structure insulating layer 30. For the illustrated embodiment, wherein K equal 2.5, $\sigma_o=3$ nC/cm$^2$ and $\sigma_{iM}=0.9$ nC/cm$^2$, the magnitude of the ion acceleration field is $E_p=5880$ volts-per-centimeter. If the distance $D_C$ in the development chamber is 0.4 centimeters, the resolution due to ion projection is approximately 21.5 line-pairs per millimeter. The average charge density of the charge image on dielectric film 62 is dependent upon the ion-flux density and the ion-projection time, and will easily exceed the 10 nC/cm$^2$ average charge density necessary for development of the charge image with toners commercially available at this time. Thus, with the ion-projection resolution of 21.5 line-pairs/mm., and with resolutions in the liquid x-ray absorber 16 and the mesh structure 25 of 20 and 25 line-pairs/mm., respectively, the resulting charge image on the dielectric film will have a resolution on the order of 7.3 line-pairs/mm.

Figure 2:
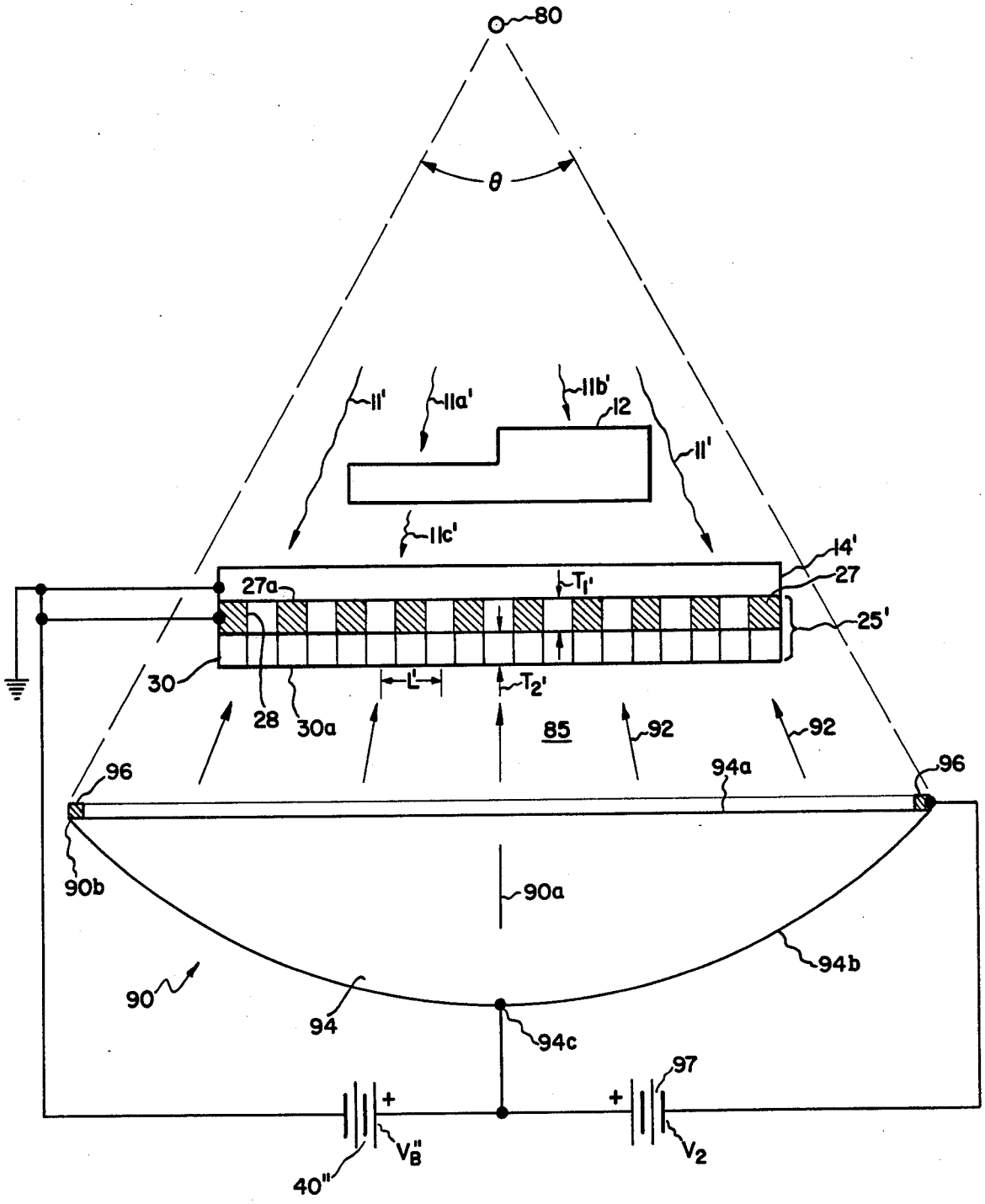
FIG. 2 is a sectional side view of another presently preferred embodiment of the present invention.

While the flat-electrode embodiment of FIG. 1 can be utilized with liquid or gaseous x-ray conversion material, an alternative preferred embodiment for use with gaseous conversion material, such as high pressure gasses of Xenon, Krypton, Freon and the like, is shown in FIG. 2. The emissions of the radiation point-source 80 are limited to a solid angle $\theta$, whereby radiation quanta 11', 11a' and 11b' are diverging from one another during passage through object 12 and at arrival on the outwardly-facing surface of first electrode 14'. In this embodiment the mesh structure 25', consisting of the conductive mesh 27 supporting insulative material 30 upon solid portions thereof, is placed directly against the differential-radiation-receiving electrode, whereby conductive layer 27 is in abutment with the interior surface of electrode 14'. The conversion gas 85 fills the apertures 28 of the mesh structure 25', and the volume between the mesh structure and the interior surface of a lower electrode structure 90. In order to cause electrode 14' to be an equipotential surface, and to generate an electric field 92 converging towards point-source 80, for elimination of the geometric unsharpness caused by the high-pressure gas in the gap between electrode 14' and 90, lower electrode 90 is designed to form concentric equipotential circular rings. Accordingly, a resistive member 94 has a planar surface 94a spaced from, and parallel to, the plane of both electrode 14' and the mesh surface 30a. An annular ring 96 of conductive material is placed about the periphery of the circular surface 94a to form a concentric equipotential guard ring. The resistive member has a non-linear radial resistance characteristic between the center line 90a and the periphery 90b of the electrode. A voltage source 97, of magnitude $V_2$, is connected between guard ring 96 and the center 94c of the curved surface 94b of the resistive member, and with polarity such that the guard ring is negative with respect to the resistive member center. A second potential source 40'' of magnitude $V_B''$ is connected between resistive member center point 94c and the grounded upper electrode 14'. The nonlinear resistance of member 90, with respect to the center axis 90a thereof (passing through centerpoint 94c), causes field lines 92 to converge toward the point source. The magnitude of electric field 92 required to collect electrons and ions in a high-pressure gas is considerably lower than the field magnitude required for collection in a liquid x-ray absorber, whereby the stress upon the mesh structure, due to the field, is smaller when high-pressure gas is utilized. The reduced magnitude of field-induced mesh distortion allows the potential and spacing between the mesh structure and the radiation-receiving electrode to be reduced substantially to zero. Additionally, a thinner and finer mesh 27 may be utilized. Typically, the center-to-center spacing L' of the mesh may be about 25 microns, with the same 50% transmission characteristic as previously discussed hereinabove with the embodiment of FIG. 1. For a mesh having a 25 micron center-to-center spacing with 50% transmission, we prefer a conductive mesh thickness $T_1'$ of between about 4 and about 10 microns, and an insulating layer thickness $T_2'$ of about 3 to about 15 microns. We have found that a typical resolution for the x-ray-absorbing high-pressure gas is on the order of 10 line-pairs/mm.; the resolution of the mesh structure is on the order of 40 line-pairs/mm. and the resolution due to ion projection is, as hereinabove mentioned, on the order of 21.5 line-pairs/mm. The resulting ion radiography system resolution is approximately 6 line-pairs per millimeter.

The present invention has been described with respect to several presently preferred embodiments thereof; many variations and modifications will now become apparent to those skilled in the art. It is our intention, therefore, that the scope of our invention be limited only by the appending claims, and not by the specific details described herein.

What is claimed is:

1. Apparatus for providing a radiograph of an object differentially absorbing radiation from a radiation source, said apparatus comprising:

an exposure chamber including a first electrode receiving the differentially-absorbed radiation; a second electrode spaced from said first electrode by a preselected distance; means filling the volume between said first and second electrodes for converting the differentially-absorbed radiation passing through said first electrode to electrically charged particles;

a mesh structure positioned within the volume of converting means between said first and second electrodes, said mesh structure including a conductive mesh and a layer of insulative material supported upon the surface of the solid portion of said mesh closest to said first electrode;

first means for providing an electric field between said first and second electrodes to cause at least some of the charged particles converted by said converting means to collect adjacent to the surface of said mesh structure insulative layer furthest from said mesh to form a charge pattern thereon representative of said object;

a development chamber including a third electrode having a surface; a sheet of insulative material supported by said third electrode surface; means spaced from said third electrode surface for projecting a stream of ions toward the insulative sheet; and second means for forming an electric field between said ion projecting means and said third electrode for accelerating said ions towards said insulative sheet;

means for moving said mesh structure from said exposure chamber, after collection of said charge pattern responsive to the differentially-absorbed radiation, to a position in said development chamber and between said third electrode surface and said ion projection means; and means for coupling at least said conductive mesh and said first and second electrodes to electrical ground potential during movement of said mesh structure;

the flow of said projected ions through said mesh structure to the surface of said insulative sheet being controlled by the charge pattern deposited upon said mesh structure insulative layer to produce a charge pattern upon the surface of said insulative sheet representative of the radiation-absorbing properties of said object.

2. The apparatus of claim 1, wherein said converting means is a material in the gaseous state and maintained at a pressure greater than atmospheric pressure.

3. The apparatus of claim 2, wherein said gaseous material is one of Xenon, Krypton and Freon.

4. The apparatus of claim 2, wherein said exposure chamber further comprises means for maintaining said gaseous material at said pressure and within the volume between said first and second electrodes.

5. The apparatus of claim 4, further comprising means for selectively filling and emptying said volume with said gaseous material at said pressure.

6. The apparatus of claim 2 wherein said mesh has about 50% transmission with apertures having about 25 microns center-to-center spacing.

7. The apparatus of claim 6, wherein said insulative layer has a thickness of between about 3 microns and about 15 microns.

8. The apparatus of claim 1, wherein said converting means is a material in the liquid state.

9. The apparatus of claim 8, wherein the liquid material is tetra-methyl-tin.

10. The apparatus of claim 8, wherein said exposure chamber further comprises means for maintaining said liquid material within the volume between said first and second electrodes.

11. The apparatus of claim 10, further comprising means for selectively filling and emptying said volume with said liquid material.

12. The apparatus of claim 8, wherein said mesh has about 50% transmission, with apertures having about 40 microns center-to-center spacing.

13. The apparatus of claim 12, wherein said insulative layer has a thickness of between about 3 microns and about 40 microns.

14. The apparatus of claim 1, wherein the conductive mesh is a foraminate film of conductive material.

15. The apparatus of claim 1, further comprising means for depositing a substantially uniform background charge density upon said insulative layer surface prior to receipt of the differentially absorbed radiation.

16. The apparatus of claim 1, wherein said mesh has a resistivity less than about $10^9$ ohms-centimeter.

17. The apparatus of claim 1, wherein said insulative layer has a resistivity greater than about $5\times10^{15}$ ohms-centimeter.

18. The apparatus of claim 1, wherein said first electrode is a planar conductive member.

19. The apparatus of claim 18, wherein said second electrode is a planar conductive member disposed parallel to the plane of said first electrode.

20. The apparatus of claim 19, wherein the distance between adjacent facing surfaces of said second electrode and the mesh of said mesh structure is between about 2 millimeters to about 4 millimeters.

21. The apparatus of claim 18, wherein said second electrode is adapted to provide, with said first electrode, an electric field converging within said exposure chamber toward said radiation source.

22. The apparatus as set forth in claim 21, wherein said second electrode includes a resistance member having a planar surface parallel to said first electrode and a curved surface opposite said planar surface and having a nonlinear resistance characteristic between a center line and the periphery thereof; and a conductive guard member disposed about the resistance member periphery; said first means including a source of electrical potential connected between the center of said resistance member curved surface and said guard member for forming concentric equipotential rings at said resistance member planar surface.

23. A method for providing at least one radiograph of an object differentially absorbing radiation from a single exposure to a radiation source, comprising the steps of:

(a) providing an exposure chamber having therein first and second spaced electrodes, and a mesh structure between the first and second electrodes and including a conductive mesh supporting a layer of insulative material, said mesh structure having a multiplicity of apertures therethrough;

(b) receiving the differentially-absorbed radiation within the exposure chamber;

(c) converting each quanta of radiation received within the exposure chamber into electrically charged particles of at least a first polarity;

(d) attracting the charged particles of the first polarity to the surface of the insulative material layer to form thereat a charge pattern representative of the radiation-absorbing parameters of said object;

(e) moving said mesh structure into a development chamber;

(f) grounding said conductive mesh and said first and second electrodes during movement of said mesh structure;

(g) providing at least one sheet of insulative material sequentially in said development chamber;

(h) projecting a stream of ions, of like polarity as the charges collected upon the surface of said insulative material layer, through the apertures in said insulative material layer;

(i) accelerating the ion stream, modulated by the pattern of charge contained upon said insulative material layer, toward the surface of each of said at least one insulative sheets; and (j) developing the pattern of ions deposited upon each of said at least one insulative sheets to provide each of the at least one radiographs of said object.

24. The method as set forth in claim 23, wherein step (c) comprises the step of: providing a quantity of a gaseous material within the exposure chamber for converting the radiation quanta into charged particles.

25. The method as set forth in claim 23, wherein step (c) comprises the step of: providing a quantity of a liquid material within the exposure chamber for converting the radiation quanta into charged particles.

26. The method as set forth in claim 23, wherein the layer of insulative material is supported upon a conductive mesh member having each a multiplicity of apertures therethrough in alignment with one of the multiplicity of apertures formed through the insulative material layer.

27. The method as set forth in claim 23, further comprising the step of depositing a substantially uniform background charge density upon the surface of the insulative material layer prior to receipt thereat of charged particles converted from the radiation quanta.

28. Apparatus for providing a radiograph of an object differentially absorbing radiation from a radiation source, said apparatus comprising:

an exposure chamber including a planar conductive member forming a first electrode receiving the differentially-absorbed radiation; a second electrode spaced from said first electrode by a preselected distance and adapted to provide, with said first electrode, an electric field converging within said exposure chamber towards said radiation source; means filling the volume between said first and second electrodes for converting the differentially-absorbed radiation passing through said first electrode to electrically charged particles;

a mesh structure positioned within the volume of converting means between said first and second electrodes, said mesh structure including a conductive mesh having a surface substantially in abutment with said first electrode, and a layer of insulative material supported upon the surface of the solid portion of said mesh closest to said first electrode;

first means for providing an electric field between said first and second electrodes to cause at least some of the charged particles converted by said converting means to collect adjacent to the surface of said mesh structure insulative layer furthest from said mesh to form a charge pattern thereon representative of said object;

a development chamber including a third electrode having a surface; a sheet of insulative material supported by said third electrode surface; means spaced from said third electrode surface for projecting a stream of ions toward the insulative sheet; and second means for forming an electric field between said ion projecting means and said third electrode for accelerating said ions towards said insulative sheet; and means for moving said mesh structure from said exposure chamber, after collection of said charge pattern responsive to the differentially-absorbed radiation, to a position in said development chamber and between said third electrode surface and said ion projection means;

the flow of said projected ions through said mesh structure to the surface of said insulative sheet being controlled by the charge pattern deposited upon said mesh structure insulative layer to produce a charge pattern upon the surface of said insulative sheet representative of the radiation-absorbing properties of said object.

* * * * *